US006131201A

United States Patent [19]

Chu

[11] Patent Number: 6,131,201

[45] Date of Patent: Oct. 17, 2000

[54] CAP WITH DETACHABLE SUNSHADE MEMBER

[76] Inventor: Li-Tsan Chu, 2 Floor, No. 15, Lane 81, Kwuang-Fu S. Rd., Taipei, Taiwan

[21] Appl. No.: 09/347,307

[22] Filed: Jul. 6, 1999

[51] Int. Cl.[7] ..... A42B 1/06

[52] U.S. Cl. ..... 2/172; 2/195.1; 2/209.13

[58] Field of Search ..... 2/172, 209.12, 2/209.13, 195.1, 175.6, 175.1

[56] References Cited

U.S. PATENT DOCUMENTS

| | | | |
|---|---|---|---|
| 2,295,826 | 9/1942 | Brav | 2/172 |
| 2,744,256 | 5/1956 | Slotkin et al. | 2/209.13 |
| 2,897,510 | 8/1959 | Forbes-Robinson | 2/172 |
| 4,312,076 | 1/1982 | Gamm | 2/209.13 |
| 4,472,837 | 9/1984 | Saxton | 2/209.13 |
| 5,046,195 | 9/1991 | Koritan | 2/195.1 |
| 5,649,327 | 7/1997 | Crewe | 2/172 |
| 5,694,648 | 12/1997 | Nucifora | 2/172 |
| 5,887,287 | 3/1999 | Potochnik | 2/172 |
| 5,996,124 | 12/1999 | Asp, Jr. | 2/172 |

*Primary Examiner*—Amy B. Vanatta

[57] ABSTRACT

A cap having a crown portion and a visor extended from a lower front of the crown portion is further provided at an upper part of the crown portion with a separated inner space for receiving a sunshade member therein and an openable top cover for closing the inner space. The crown portion is provided along a lower rear outer periphery with male fastener and the sunshade member is provided along an upper inner edge with female fastener. By opening the top cover, the sunshade member may be removed from the inner space in the crown portion and detachably attached to rear side of the crown portion by engaging the female fastener with the male fastener. The sunshade member connected to rear side of the crown portion of the cap may shield a large area of a wearer's nape and cheeks from sunrays.

7 Claims, 2 Drawing Sheets

CAP WITH DETACHABLE SUNSHADE MEMBER

BACKGROUND OF THE INVENTION

The present invention relates to a cap, and more particularly to a cap provided with a separated inner space for accommodating a sunshade that may be conveniently taken out to detachably connect to the cap to shield a large area of a wearer's nape and cheeks from sunrays.

A cap is a common headgear for putting on a wearer's head to protect the head and eyes from harmful sunrays or rainwater. The cap can also form a decorative part of the wearer's attire.

A cap generally includes a crown portion for covering an upper part of a wearer's head, and a visor extended from a lower front of the crown portion for shielding the wearer's eyes from sunrays. A cap with such a structure can only be used to protect a portion of the wearer's head above the eyes. The wearer's nape and cheeks that are not covered by the cap or clothes are still exposed to the strong and harmful sunrays. To protect these areas against the scorching sun, people would usually apply sunscreen product over skin of these areas, or use an additional means, such as a towel, a handkerchief, etc., to cover these areas. In countryside, farmers would sew a piece of cloth to the edge of a hat or cap in an attempt to protect their nape and cheeks from the strong sunrays. However, such cloth sewed on the hat or cap is not removable as desired and does not always meet the requirement of esthetics.

It is therefore desirable to develop a cap that not only shields a wearer's head top and eyes from sunrays or rainwater, but also protects the wearer's nape and cheeks as actual need, while the cap can still function as a good decorative means to the wearer's attire.

SUMMARY OF THE INVENTION

A primary object of the present invention is to provide a cap that is provided with a separated inner space below a top cover thereof for accommodating a sunshade that may be conveniently taken out to detachably connect to the cap as actual need to shield a large area of a wearer's nape and cheeks from sunrays.

To achieve the above and other objects, the cap provided by the present invention mainly includes a crown portion for covering a wearer's head top and a visor extended from a lower front of the crown portion for protecting the wearer's eyes against direct sunrays. The cap is characterized in a top cover connected to the crown portion by means of a zipper or the like, an interior storage space separated inner space provided in the crown portion below the top cover, and a detachable sunshade member member accommodated in the interior storage space to be detachably attached to a rear side of the crown portion. When the zipper is opened, the top cover may be pivotally lifted from the crown portion to show the interior storage space and the sunshade member positioned therein. To allow the sunshade member to be conveniently and detachably connected to the crown portion at any time as necessary for shielding the wearer's nape and cheeks from sunrays, catching means are provided at lower rear outer periphery of the crown portion and corresponding fastening means are provided at upper inner edge of the detachable sunshade member. When the sunshade member is not in use, it may be put back into the interior storage space space that may be then closed by the top cover by closing the zipper.

BRIEF DESCRIPTION OF THE DRAWINGS

The structural features of the present invention can be best understood by referring to the following detailed description of the preferred embodiments and the accompanying drawings, wherein.

DETAILED DESCRIPTION OF THE PREFERRED EMBODIMENTS

Figure 1:
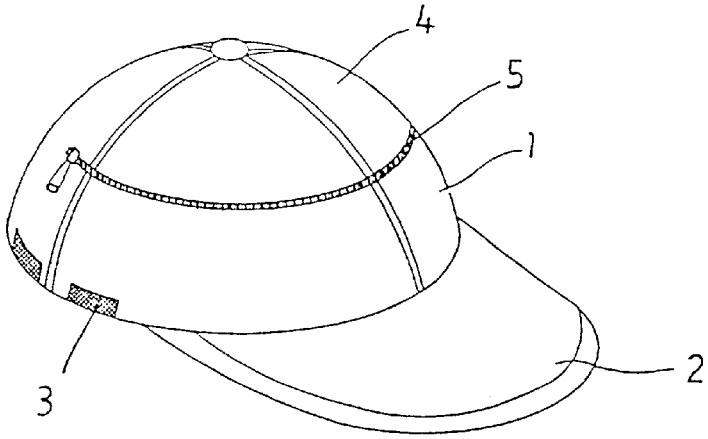
FIG. 1 is a perspective of a cap according to the present invention.
Figure 2:
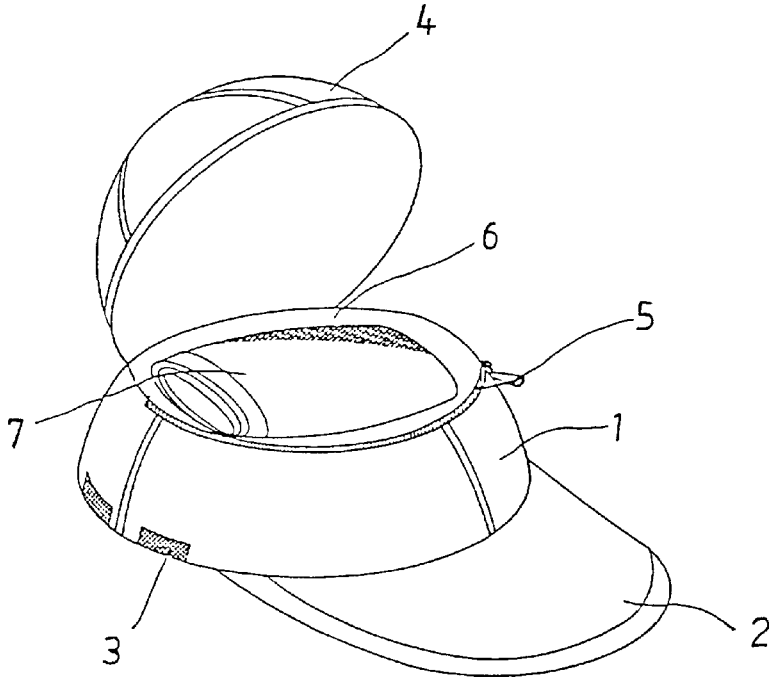
FIG. 2 is the cap of FIG. 1 with a top cover thereof being lifted to show the interior storage space in the cap below the top cover for accommodating a sunshade member therein.

Please refer to FIGS. 1 and 2. The present invention provides a cap having a crown portion 1 and a visor 2 forward extended from a lower front edge of the crown portion 1. The cap is provided along a part of its lower outer periphery behind the visor 2 with catching means, such as some spaced pieces of male part 3 of magic tape (that is a type of woven fabric fastener and usually known as a VELCRO tape). The crown portion 1 includes a top cover 4, a part of which is openably connected to the crown portion 1 by means of a locking means 5, such as a zipper, so that the top cover 4 may be pivotally lifted from the crown portion 1 as shown in FIG. 2. An interior storage space 6 is provided in an upper part of the crown portion 1 below the top cover 4 and can be easily shown by opening the zipper 5 and pivotally lifting the top cover 4. A detachable sunshade member 7 having a suitable shape is positioned in the interior storage space 6 and may be taken out from there at any time.

Figure 3:
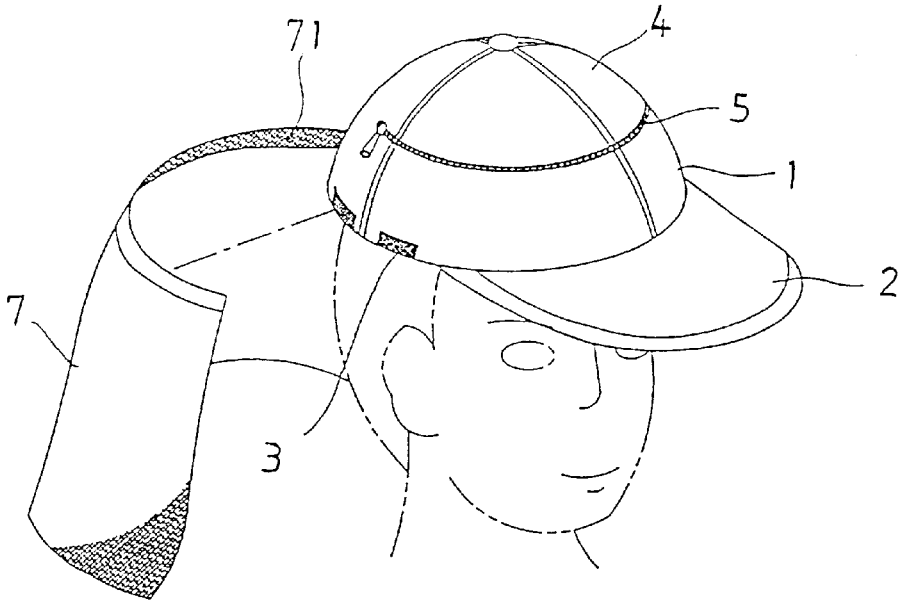
FIG. 3 illustrates the manner of connecting the sunshade member to the lower rear edge of the cap.
Figure 4:
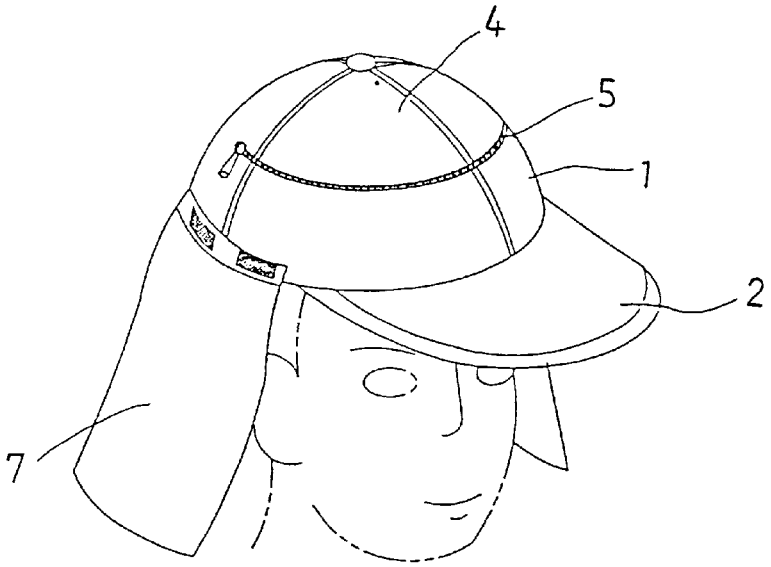
FIG. 4 illustrates the cap of the present invention with the sunshade member detachably connected to the lower rear edge thereof.

Please refer to FIGS. 3 and 4. The sunshade member 7 is provided along a top inner edge with a fastening means, such as a continuous strip of female part 71 of the magic tape (or the woven fabric fastener). By attaching the female part 71 of the magic tape on the sunshade member 7 to the male part 3 of the magic tape on the crown portion 1, the sunshade member 7 may be easily connected to the cap to form a shade at a rear side of the cap. When a wearer puts on the cap with the sunshade member 7 connected thereto, the sunshade member 7 will shield a large area of the wearer's nape and cheeks from the scorching sun.

It is understood that means other than the male part 3 and the female part 71 of the magic tape may be used to detachably connect the sunshade member 7 to the crown portion 1 of the cap. Such means include but not limited to male and female connectors, and buttons and buttonholes.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A cap comprising:

a crown portion for covering a top of a wearer's head and a visor extended from a lower front of said crown portion for protecting the wearer's eyes against direct sun or rain; said crown portion includes at an upper part thereof an openable interior storage space, said interior storage space being situated above the wearer's head such that said interior storage space does not affect a fit of said cap, and a plurality of catching means are fixed to a lower rear outer periphery of said crown portion; and a detachable sunshade member stored in said interior storage space in said crown portion, said detachable sunshade member being provided along a top inner edge with a fastening means for detachably connecting to said catching means on said crown portion whereby when said detachable sunshade member is taken out of said interior storage space and detachably connected to said crown portion by attaching said fastening means on said sunshade member to said catching means on said crown portion, a large area of a nape of a wearer's neck and cheeks are shielded by said detachable sunshade member.

2. The cap as claimed in claim 1, wherein said catching means and said fastening means provided on said crown portion and said detachable sunshade are hook and loop fasteners.

3. The cap as claimed in claim 1, wherein said catching means and said fastening means provided on said crown portion and said detachable sunshade member are male and female connectors.

4. The cap as claimed in claim 3, wherein said male and said female connectors are buttonholes and buttons.

5. The cap as claimed in claim 1, wherein said interior storage space is located between said upper part of said crown portion and a top cover of said crown portion that can be partially lifted from said crown portion to reveal said interior storage space.

6. The cap as claimed in claim 5, wherein said top cover is connected along a part of a periphery thereof to said crown portion by a locking means.

7. The cap as claimed in claim 6, wherein said locking means is a zipper.

* * * * *